US011439192B2

(12) United States Patent
Bock

(10) Patent No.: US 11,439,192 B2
(45) Date of Patent: Sep. 13, 2022

(54) METHOD FOR PUTTING ON OR TAKING OFF A PIECE OF CLOTHING OR FOR CLOSING, PUTTING ON, OPENING, OR TAKING OFF A PIECE OF LUGGAGE

(71) Applicant: PUMA SE, Herzogenaurach (DE)

(72) Inventor: Markus Bock, Herzogenaurach (DE)

(73) Assignee: PUMA SE, Herzogenaurach (DE)

( * ) Notice: Subject to any disclaimer, the term of this patent is extended or adjusted under 35 U.S.C. 154(b) by 702 days.

(21) Appl. No.: 16/462,045

(22) PCT Filed: Nov. 22, 2016

(86) PCT No.: PCT/EP2016/001967

§ 371 (c)(1),
(2) Date: May 17, 2019

(87) PCT Pub. No.: WO2018/095500

PCT Pub. Date: May 31, 2018

(65) Prior Publication Data

US 2019/0328067 A1 Oct. 31, 2019

(51) Int. Cl.
*A41F 1/00* (2006.01)
*A42B 1/22* (2006.01)
(Continued)

(52) U.S. Cl.
CPC ..... *A41F 1/00* (2013.01); *A41D 1/002* (2013.01); *A42B 1/22* (2013.01); *A42B 1/242* (2013.01);
(Continued)

(58) Field of Classification Search
CPC ..... A41F 1/00; A43B 3/34
See application file for complete search history.

(56) References Cited

U.S. PATENT DOCUMENTS 4,724,626 A 2/1988 Baggio
4,741,115 A 5/1988 Pozzobon
(Continued)

FOREIGN PATENT DOCUMENTS

CA 2500150 A1 9/2006
CN 2540805 Y 3/2003
(Continued)

OTHER PUBLICATIONS

International Search Report of International Application No. PCT/EP2016/001968, dated Jul. 31, 2017, 6 pages.
(Continued)

*Primary Examiner* — Robert Sandy
(74) *Attorney, Agent, or Firm* — Quarles & Brady LLP

(57) ABSTRACT

A method for putting on or taking off a piece of clothing or for closing, putting on, opening, or taking off a piece of luggage, including the steps of tightening or loosening by means of a tensioning element driven by a driven tension roller and a switching element. The tightening or loosening takes place by actuation of the switching element. The switching element has a number of contact-sensitive sensors which are arranged adjacent to one another and form a surface accessible to the user of the piece of clothing or of the piece of luggage. The method includes the steps of scanning the surface of the sensors by the user in a first direction, detecting the signal of the sensors by a controller, and causing a first tensioning force level or a first closing path of the tensioning element to be initiated by the controller and the electric motor.

19 Claims, 2 Drawing Sheets

Figure 1:
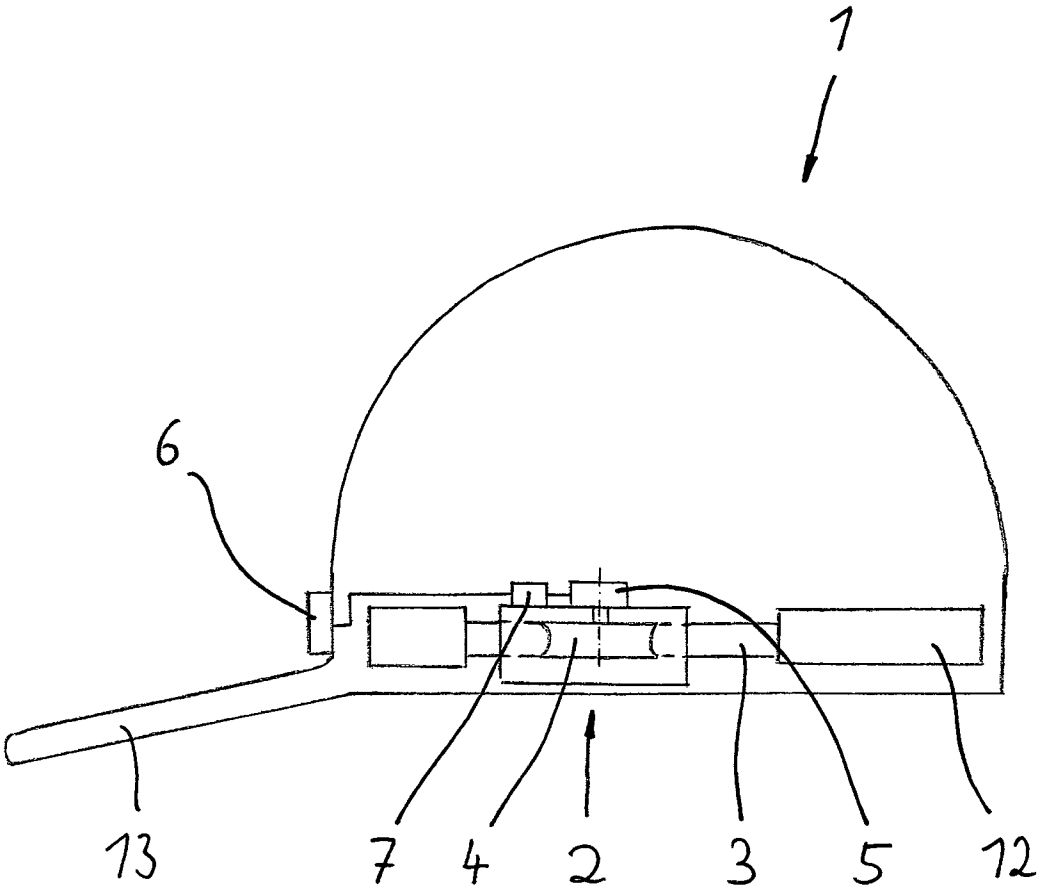

(51) Int. Cl.

| | |
|---|---|
| ***A45F 3/00*** | (2006.01) |
| ***A41D 1/00*** | (2018.01) |
| ***A42B 1/242*** | (2021.01) |
| ***B65H 59/00*** | (2006.01) |
| *A42B 1/24* | (2021.01) |
| *A45C 13/10* | (2006.01) |
| *A42B 3/14* | (2006.01) |
| *A45F 3/02* | (2006.01) |
| *A45F 3/04* | (2006.01) |

(52) U.S. Cl.

CPC ..... *A45F 3/00* (2013.01); *B65H 59/00* (2013.01); *A41D 2400/44* (2013.01); *A42B 3/145* (2013.01); *A45C 13/10* (2013.01); *A45F 3/02* (2013.01); *A45F 3/04* (2013.01); *A45F 2003/001* (2013.01)

(56) References Cited

U.S. PATENT DOCUMENTS

| | | | | |
|---|---|---|---|---|
| 4,748,726 | A | 6/1988 | Schoch | |
| 4,787,124 | A | 11/1988 | Pozzobon et al. | |
| 4,922,634 | A | 5/1990 | Seidel | |
| 4,961,544 | A | 10/1990 | Bidoia | |
| 5,051,095 | A | 9/1991 | Slenker | |
| 5,206,804 | A | 4/1993 | Thies et al. | |
| 5,325,613 | A | 7/1994 | Sussmann | |
| 5,724,265 | A | 3/1998 | Hutchings | |
| 5,839,210 | A | 11/1998 | Bernier et al. | |
| 5,955,667 | A | 9/1999 | Fyfe | |
| 5,983,530 | A | 11/1999 | Chou | |
| 6,018,705 | A | 1/2000 | Gaudet et al. | |
| 6,032,387 | A | 3/2000 | Johnson | |
| 6,052,654 | A | 4/2000 | Gaudet et al. | |
| 6,202,953 | B1 | 3/2001 | Hammerslag | |
| 6,289,558 | B1 | 9/2001 | Hammerslag | |
| 6,427,361 | B1 | 8/2002 | Chou | |
| 6,430,843 | B1 | 8/2002 | Potter et al. | |
| 6,691,433 | B2 | 2/2004 | Liu | |
| 6,865,825 | B2 | 3/2005 | Bailey, Sr. et al. | |
| 6,876,947 | B1 | 4/2005 | Darley et al. | |
| 6,882,955 | B1 | 4/2005 | Ohlenbusch et al. | |
| 6,892,477 | B2 | 5/2005 | Potter et al. | |
| 6,978,684 | B2 | 12/2005 | Nurse | |
| 7,082,701 | B2 | 8/2006 | Dalgaard et al. | |
| 7,096,559 | B2 | 8/2006 | Johnson | |
| 7,188,439 | B2 | 3/2007 | DiBenedetto et al. | |
| 7,310,895 | B2 | 12/2007 | Whittlesey et al. | |
| 7,503,131 | B2 | 3/2009 | Nadel et al. | |
| 7,607,243 | B2 | 10/2009 | Berner, Jr. et al. | |
| 7,721,468 | B1 | 5/2010 | Johnson et al. | |
| 7,752,774 | B2 | 7/2010 | Ussher | |
| 7,794,101 | B2 | 9/2010 | Galica et al. | |
| D648,110 | S | 11/2011 | Rasmussen | |
| 3,061,061 | A1 | 11/2011 | Rivas | |
| 8,046,937 | B2 | 11/2011 | Beers et al. | |
| 8,056,269 | B2 | 11/2011 | Beers et al. | |
| 8,058,837 | B2 | 11/2011 | Beers et al. | |
| 8,061,061 | B1 | 11/2011 | Rivas | |
| 8,074,379 | B2 | 12/2011 | Robinson, Jr. et al. | |
| 8,277,401 | B2 | 10/2012 | Hammerslag et al. | |
| 8,387,282 | B2 | 3/2013 | Baker et al. | |
| 8,424,168 | B2 | 4/2013 | Soderberg et al. | |
| 8,468,657 | B2 | 6/2013 | Soderberg et al. | |
| 8,474,146 | B2 | 7/2013 | Hartford et al. | |
| 8,516,662 | B2 | 8/2013 | Goodman et al. | |
| D689,684 | S | 9/2013 | McMillan | |
| 8,522,456 | B2 | 9/2013 | Beers et al. | |
| 8,528,235 | B2 | 9/2013 | Beers et al. | |
| 8,676,541 | B2 | 3/2014 | Schrock et al. | |
| 8,678,541 | B2 | 3/2014 | Uchiyama | |
| 8,713,820 | B2 | 5/2014 | Kerns et al. | |
| 8,739,639 | B2 | 6/2014 | Owings et al. | |
| 8,769,844 | B2 | 7/2014 | Beers et al. | |
| D718,036 | S | 11/2014 | McMillan | |
| 8,904,672 | B1 | 12/2014 | Johnson | |
| 8,904,673 | B2 | 12/2014 | Johnson et al. | |
| 8,935,860 | B2 | 1/2015 | Torres | |
| 9,072,341 | B2 | 7/2015 | Jungkind | |
| D740,538 | S | 10/2015 | Roulo | |
| 9,149,089 | B2 | 10/2015 | Cotterman et al. | |
| 9,204,690 | B1 | 12/2015 | Alt et al. | |
| D746,558 | S | 1/2016 | Campbell et al. | |
| 9,241,539 | B1 | 1/2016 | Keswin | |
| 9,248,040 | B2 | 2/2016 | Soderberg et al. | |
| D750,879 | S | 3/2016 | Klein et al. | |
| 9,301,573 | B2 | 4/2016 | Jasmine | |
| 9,307,804 | B2 | 4/2016 | Beers et al. | |
| D756,621 | S | 5/2016 | Weddle | |
| 9,326,566 | B2 | 5/2016 | Beers et al. | |
| 9,365,387 | B2 | 6/2016 | Beers et al. | |
| 9,380,834 | B2 | 7/2016 | Rushbrook et al. | |
| D768,977 | S | 10/2016 | Seamarks et al. | |
| 9,462,844 | B2 | 10/2016 | Schrock et al. | |
| 9,532,893 | B2 | 1/2017 | Beers et al. | |
| 9,578,926 | B2 | 2/2017 | Alt et al. | |
| 9,609,918 | B2 | 4/2017 | Beers | |
| 9,610,185 | B2 | 4/2017 | Capra et al. | |
| 9,629,418 | B2 | 4/2017 | Rushbrook et al. | |
| 9,693,605 | B2 | 7/2017 | Beers | |
| 9,706,814 | B2 | 7/2017 | Converse et al. | |
| 9,756,895 | B2 | 9/2017 | Rice et al. | |
| 9,763,489 | B2 | 9/2017 | Amos et al. | |
| 9,848,674 | B2 | 12/2017 | Smith et al. | |
| 9,861,164 | B2 | 1/2018 | Beers et al. | |
| 9,861,165 | B2 | 1/2018 | Schneider et al. | |
| 9,867,417 | B2 | 1/2018 | Beers et al. | |
| 9,872,539 | B2 | 1/2018 | Beers | |
| 9,907,359 | B2 | 3/2018 | Beers | |
| 9,918,865 | B2 | 3/2018 | Nickel et al. | |
| D814,776 | S | 4/2018 | Odinot | |
| D815,413 | S | 4/2018 | Weddle | |
| 9,943,139 | B2 | 4/2018 | Beers et al. | |
| 9,961,963 | B2 | 5/2018 | Schneider et al. | |
| 9,993,046 | B2 | 6/2018 | Bock | |
| 10,004,295 | B2 | 6/2018 | Gerber | |
| 10,010,129 | B2 | 7/2018 | Beers et al. | |
| 10,034,512 | B2 | 7/2018 | Rushbrook et al. | |
| 10,046,942 | B2 | 8/2018 | Beers et al. | |
| 10,070,681 | B2 | 9/2018 | Beers et al. | |
| 10,070,683 | B2 | 9/2018 | Rushbrook et al. | |
| 10,076,462 | B2 | 9/2018 | Johnson et al. | |
| D829,425 | S | 10/2018 | Albrecht et al. | |
| 10,085,517 | B2 | 10/2018 | Beers et al. | |
| 10,092,065 | B2 | 10/2018 | Rushbrook et al. | |
| 10,102,722 | B2 | 10/2018 | Levesque et al. | |
| 10,104,937 | B2 | 10/2018 | Beers et al. | |
| 10,111,496 | B2 | 10/2018 | Schneider et al. | |
| 10,201,212 | B2 | 2/2019 | Beers et al. | |
| 10,231,505 | B2 | 3/2019 | Beers et al. | |
| 10,238,180 | B2 | 3/2019 | Beers et al. | |
| 10,441,020 | B1 | 10/2019 | Andon et al. | |
| 11,000,099 | B2 * | 5/2021 | Beers ..... | A43C 11/165 |
| 11,044,968 | B2 * | 6/2021 | Beers ..... | A43C 11/165 |
| 2003/0009913 | A1 | 1/2003 | Potter et al. | |
| 2003/0150135 | A1 | 8/2003 | Liu | |
| 2004/0177531 | A1 | 9/2004 | DiBenedetto et al. | |
| 2005/0183292 | A1 | 8/2005 | DiBenedetto et al. | |
| 2005/0198867 | A1 | 9/2005 | Labbe | |
| 2006/0000116 | A1 | 1/2006 | Brewer | |
| 2006/0103538 | A1 | 5/2006 | Daniel | |
| 2007/0000154 | A1 | 1/2007 | DiBenedetto et al. | |
| 2007/0006489 | A1 | 1/2007 | Case et al. | |
| 2007/0129907 | A1 | 6/2007 | Demon | |
| 2007/0164521 | A1 | 7/2007 | Robinson | |
| 2007/0260421 | A1 | 11/2007 | Berner et al. | |
| 2007/0271817 | A1 | 11/2007 | Ellis | |
| 2008/0066272 | A1 | 3/2008 | Hammerslag et al. | |
| 2008/0301919 | A1 | 12/2008 | Ussher | |
| 2009/0184189 | A1 | 7/2009 | Soderberg et al. | |
| 2009/0193689 | A1 | 8/2009 | Galica et al. | |
| 2009/0272007 | A1 | 11/2009 | Beers et al. | |
| 2009/0272013 | A1 | 11/2009 | Beers et al. | |

(56) References Cited

U.S. PATENT DOCUMENTS

| | | | |
|---|---|---|---|
| 2010/0063778 | A1 | 3/2010 | Schrock et al. |
| 2010/0063779 | A1 | 3/2010 | Schrock et al. |
| 2010/0139057 | A1 | 6/2010 | Soderberg et al. |
| 2010/0289971 | A1 | 11/2010 | Odland et al. |
| 2011/0025704 | A1 | 2/2011 | Odland et al. |
| 2011/0175744 | A1 | 7/2011 | Englert et al. |
| 2011/0225843 | A1 | 9/2011 | Kerns et al. |
| 2011/0232134 | A1 | 9/2011 | Radl et al. |
| 2011/0266384 | A1 | 11/2011 | Goodman et al. |
| 2012/0000091 | A1 | 1/2012 | Cotterman et al. |
| 2012/0004587 | A1 | 1/2012 | Nickel et al. |
| 2012/0067665 | A1 | 3/2012 | Chae et al. |
| 2012/0124500 | A1 | 5/2012 | Hunter |
| 2012/0185801 | A1 | 7/2012 | Madonna et al. |
| 2013/0092780 | A1 | 4/2013 | Soderberg et al. |
| 2013/0104429 | A1 | 5/2013 | Torres |
| 2013/0213147 | A1 | 8/2013 | Rice et al. |
| 2013/0312293 | A1 | 11/2013 | Gerber |
| 2014/0068838 | A1 | 3/2014 | Beers et al. |
| 2014/0070042 | A1 | 3/2014 | Beers et al. |
| 2014/0082963 | A1 | 3/2014 | Beers |
| 2014/0257156 | A1 | 9/2014 | Capra et al. |
| 2014/0292396 | A1 | 10/2014 | Bruwer et al. |
| 2015/0007422 | A1 | 1/2015 | Cavanagh et al. |
| 2015/0185764 | A1 | 7/2015 | Magi |
| 2015/0250268 | A1 | 9/2015 | Alt et al. |
| 2015/0289594 | A1 | 10/2015 | Rushbrook et al. |
| 2015/0312660 | A1 | 10/2015 | Lembacher et al. |
| 2016/0027297 | A1* | 1/2016 | Wu ..... G04G 21/08 340/12.5 |
| 2016/0157561 | A1 | 6/2016 | Schum et al. |
| 2016/0256349 | A1 | 9/2016 | Mayer et al. |
| 2016/0262485 | A1 | 9/2016 | Walker |
| 2016/0345654 | A1 | 12/2016 | Beers et al. |
| 2016/0345679 | A1 | 12/2016 | Beers et al. |
| 2016/0345681 | A1 | 12/2016 | Pheil et al. |
| 2016/0360828 | A1 | 12/2016 | Guyan |
| 2017/0035151 | A1 | 2/2017 | Peyton et al. |
| 2017/0150773 | A1 | 6/2017 | Beers |
| 2017/0215524 | A1 | 8/2017 | Rushbrook et al. |
| 2017/0265572 | A1 | 9/2017 | Beers et al. |
| 2017/0265573 | A1 | 9/2017 | Beers et al. |
| 2017/0265574 | A1 | 9/2017 | Beers et al. |
| 2017/0265575 | A1 | 9/2017 | Beers et al. |
| 2017/0265576 | A1 | 9/2017 | Beers et al. |
| 2017/0265577 | A1 | 9/2017 | Schneider |
| 2017/0265578 | A1 | 9/2017 | Schneider |
| 2017/0265579 | A1 | 9/2017 | Schneider et al. |
| 2017/0265580 | A1 | 9/2017 | Schneider et al. |
| 2017/0265581 | A1 | 9/2017 | Chang |
| 2017/0265582 | A1 | 9/2017 | Walker et al. |
| 2017/0265583 | A1 | 9/2017 | Schneider et al. |
| 2017/0265584 | A1 | 9/2017 | Walker et al. |
| 2017/0265585 | A1 | 9/2017 | Orand |
| 2017/0265586 | A1 | 9/2017 | Schneider et al. |
| 2017/0265587 | A1 | 9/2017 | Walker et al. |
| 2017/0265588 | A1 | 9/2017 | Walker et al. |
| 2017/0265589 | A1 | 9/2017 | Walker et al. |
| 2017/0265591 | A1 | 9/2017 | Schneider |
| 2017/0265594 | A1 | 9/2017 | Walker et al. |
| 2017/0267485 | A1 | 9/2017 | Schneider et al. |
| 2017/0272008 | A1 | 9/2017 | Schneider |
| 2017/0295889 | A1 | 10/2017 | Beers |
| 2017/0303643 | A1 | 10/2017 | Converse et al. |
| 2017/0312161 | A1 | 11/2017 | Johnson et al. |
| 2017/0318908 | A1 | 11/2017 | Wyatt et al. |
| 2017/0332734 | A1 | 11/2017 | Orand |
| 2017/0332735 | A1 | 11/2017 | Orand et al. |
| 2017/0340049 | A1 | 11/2017 | Rice et al. |
| 2018/0020764 | A1 | 1/2018 | Walker |
| 2018/0035760 | A1 | 2/2018 | Bock |
| 2018/0110288 | A1 | 4/2018 | Hatfield et al. |
| 2018/0110294 | A1 | 4/2018 | Schneider et al. |
| 2018/0110298 | A1 | 4/2018 | Schneider et al. |
| 2018/0116326 | A1 | 5/2018 | Beers et al. |
| 2018/0125168 | A1 | 5/2018 | Beers et al. |
| 2018/0153260 | A1 | 6/2018 | Beers |
| 2018/0153263 | A1 | 6/2018 | Beers et al. |
| 2018/0199674 | A1 | 7/2018 | Walker et al. |
| 2018/0219403 | A1 | 8/2018 | Schneider |
| 2018/0228250 | A1 | 8/2018 | Beers et al. |
| 2018/0263340 | A1 | 9/2018 | Schneider et al. |
| 2018/0289110 | A1 | 10/2018 | Bock et al. |
| 2018/0310644 | A1 | 11/2018 | Poupyrev et al. |
| 2018/0310659 | A1 | 11/2018 | Poupyrev et al. |
| 2018/0310670 | A1 | 11/2018 | Rovekamp, Jr. et al. |
| 2018/0317609 | A1 | 11/2018 | Beers et al. |
| 2018/0342978 | A1 | 11/2018 | Joardar |
| 2018/0343977 | A1 | 12/2018 | Riccomini et al. |
| 2018/0368526 | A1 | 12/2018 | Bock et al. |
| 2018/0368528 | A1 | 12/2018 | Beers et al. |
| 2019/0246745 | A1 | 8/2019 | Bock et al. |
| 2019/0246746 | A1 | 8/2019 | Bock et al. |
| 2019/0246747 | A1 | 8/2019 | Bock et al. |
| 2021/0162120 | A1 | 6/2021 | Prudden et al. |
| 2021/0383784 | A1 | 12/2021 | Leatherdale et al. |

FOREIGN PATENT DOCUMENTS

| | | | |
|---|---|---|---|
| CN | 201222723 | Y | 4/2009 |
| CN | 102058197 | A | 5/2011 |
| CN | 202907266 | U | 4/2013 |
| CN | 104585975 | A | 5/2015 |
| CN | 104822284 | A | 8/2015 |
| CN | 105278768 | A | 1/2016 |
| DE | 29701491 | U1 | 5/1998 |
| DE | 29817003 | U1 | 3/1999 |
| DE | 19833801 | A1 | 2/2000 |
| DE | 102005014709 | A1 | 10/2006 |
| DE | 102005036013 | A1 | 2/2007 |
| DE | 102005052903 | A1 | 5/2007 |
| EP | 0614624 | A1 | 9/1994 |
| EP | 2871994 | A1 | 5/2015 |
| EP | 3046434 | A1 | 7/2016 |
| FR | 2924577 | A1 | 6/2009 |
| GB | 2449722 | A | 12/2008 |
| JP | 3005659 | U | 1/1995 |
| JP | 3195320 | B2 | 8/2001 |
| JP | 2004267784 | A | 9/2004 |
| JP | 2004275201 | A | 10/2004 |
| JP | 2009011460 | A | 1/2009 |
| JP | 2011519611 | A | 7/2011 |
| JP | 5486203 | B2 | 5/2014 |
| JP | 2016530058 | A | 9/2016 |
| KR | 100398822 | B1 | 9/2003 |
| KR | 1020050122149 | A | 9/2003 |
| WO | 1998011797 | A1 | 9/2003 |
| WO | 2008033963 | A2 | 3/2008 |
| WO | 2009134858 | A1 | 11/2009 |
| WO | 2012109244 | A1 | 8/2012 |
| WO | 2014036374 | A1 | 3/2014 |
| WO | 2014082652 | A1 | 6/2014 |
| WO | 2015014374 | A1 | 2/2015 |
| WO | 2015042216 | A1 | 3/2015 |
| WO | 2015045598 | A1 | 4/2015 |
| WO | 2015056633 | A1 | 4/2015 |
| WO | 2015160406 | A1 | 10/2015 |
| WO | 2015160768 | A1 | 10/2015 |
| WO | 2015160790 | A1 | 10/2015 |
| WO | 2015163982 | A1 | 10/2015 |
| WO | 2016057697 | A1 | 4/2016 |
| WO | 2016191115 | A1 | 12/2016 |
| WO | 2016191117 | A1 | 12/2016 |
| WO | 2016191123 | A1 | 12/2016 |
| WO | 2016195957 | A1 | 12/2016 |
| WO | 2016195965 | A1 | 12/2016 |
| WO | 2017059876 | A1 | 4/2017 |
| WO | 2017091769 | A1 | 6/2017 |
| WO | 2017092775 | A1 | 6/2017 |
| WO | 2017095945 | A1 | 6/2017 |
| WO | 2017158410 | A1 | 9/2017 |
| WO | 2017160534 | A2 | 9/2017 |
| WO | 2017160536 | A2 | 9/2017 |
| WO | 2017160558 | A2 | 9/2017 |

(56) References Cited

FOREIGN PATENT DOCUMENTS

| | | | |
|---|---|---|---|
| WO | 2017160561 | A2 | 9/2017 |
| WO | 2017160563 | A2 | 9/2017 |
| WO | 2017160657 | A2 | 9/2017 |
| WO | 2017160708 | A2 | 9/2017 |
| WO | 2017160865 | A1 | 9/2017 |
| WO | 2017160866 | A1 | 9/2017 |
| WO | 2017160881 | A1 | 9/2017 |
| WO | 2017160969 | A1 | 9/2017 |
| WO | 2017161000 | A2 | 9/2017 |
| WO | 2017161014 | A1 | 9/2017 |
| WO | 2017161037 | A1 | 9/2017 |
| WO | 2017161044 | A1 | 9/2017 |
| WO | 2017164612 | A1 | 9/2017 |
| WO | 2017185160 | A1 | 11/2017 |
| WO | 2017189926 | A1 | 11/2017 |
| WO | 2017197627 | A1 | 11/2017 |
| WO | 2017091769 | A8 | 1/2018 |
| WO | 2018028380 | A1 | 2/2018 |
| WO | 2018028381 | A1 | 2/2018 |
| WO | 2018081260 | A1 | 5/2018 |
| WO | 2018094156 | A1 | 5/2018 |
| WO | 2018095500 | A1 | 5/2018 |
| WO | 2018095501 | A1 | 5/2018 |
| WO | 2018120085 | A1 | 7/2018 |
| WO | 2017161000 | A3 | 8/2018 |
| WO | 2018170148 | A2 | 9/2018 |
| WO | 2018170148 | A3 | 11/2018 |
| WO | 2018222805 | A2 | 12/2018 |
| WO | 2018222807 | A2 | 12/2018 |
| WO | 2018222836 | A2 | 12/2018 |

OTHER PUBLICATIONS

Written Opinion of International Application No. PCT/EP2016/001968, dated Jul. 31, 2017, 6 pages.
International Preliminary Report on Patentability (Form IPEA/409) of International Application No. PCT/EP2016/001968, dated Jan. 9, 2019, 31 pages.
International Search Report of International Application No. PCT/EP2016/001967, dated Jul. 26, 2017, 7 pages.
Written Opinion of International Application No. PCT/EP2016/001967, dated Jul. 26, 2017, 6 pages.
International Preliminary Report on Patentability (Form IPEA/409) of International Application No. PCT/EP2016/001967, dated Jan. 4, 2019, 23 pages.
International Search Report of International Application No. PCT/EP2015/001963, dated Aug. 9, 2016, 5 pages.
Japanese Office Action from corresponding Japanese Patent Application No. 2019-525884, dated Aug. 25, 2020 (English translation included) (8 pages).
Notice of Reasons for Refusal issued in Japanese Application No. 2018-524270, dated Dec. 3, 2019, 9 pages.
Search Report by Registered Search Organization issued in Japanese Application No. 2018-524270, dated Nov. 27, 2019, 128 pages.
International Search Report and Written Opinion of International Application No. PCT/IB2020/053777, dated Jun. 18, 2020, 12 pages.
International Search Report and Written Opinion of International Application No. PCT/IB2020/053778, dated Jun. 18, 2020, 14 pages.
The First Office Action issued in corresponding Chinese Application No. 201580084987.2, dated May 6, 2020, 25 pages.
Invitation to Pay Additional Fees and Communication Relating to Results of Partial International Search Report from corresponding PCT Application No. PCT/IB2020/058424 dated Dec. 8, 2020 (12 pages).
International Search Report of International Application No. PCT/EP2016/001967, dated Jul. 31, 2017, 6 pages.
Written Opinion of International Application No. PCT/EP2016/001967, dated Jul. 31, 2017, 6 pages.
International Preliminary Report on Patentability (Form IPEA/409) of International Application No. PCT/EP2016/001967, dated Jan. 9, 2019, 31 pages.
Andrew Liszewski: "A Self-Adjusting Smart Belt: Yes, It's Come to This", Jan. 4, 2015 (Jan. 4, 2015), Retrieved from the Internet: URL: https://gizmodo.com/the-only-gadget-the-world-really-needs-is-a-self-adjust-1677432880 [retrieved on May 16, 2019].
First Office Action from corresponding Chinese Patent Application No. 201680091016.5, dated Oct. 22, 2020 (15 pages).
The First Office Action issued in corresponding Chinese Application No. 201680091000.4, dated Jun. 5, 2020, 19 pages.

* cited by examiner

METHOD FOR PUTTING ON OR TAKING OFF A PIECE OF CLOTHING OR FOR CLOSING, PUTTING ON, OPENING, OR TAKING OFF A PIECE OF LUGGAGE

This application is a U.S. National Stage application, filed pursuant to 35 U.S.C. § 371, of international application no. PCT/EP2016/001967, filed on Nov. 22, 2016, the contents of which is incorporated herein by reference in its entirety.

The invention relates to a method for putting on or taking off a piece of clothing onto the wearer or from the wearer of the same or for closing, putting on, opening, or taking off a piece of luggage carried by a person, wherein the piece of clothing or the piece of luggage comprises:

a rotary closure for tightening of the piece of clothing at the wearer or loosening of the same from the wearer or for closing, putting on, opening or taking off the piece of luggage by means of at least one tensioning element, wherein the rotary closure comprises a rotatably arranged tensioning roller for winding the tensioning element, wherein the tensioning roller being driven by means of an electric motor, a switching element which is connected to control means, wherein the switching element and the control means can actuate the electric motor, wherein the tightening of the piece of clothing at the wearer or loosening of the same from the wearer or the closing, putting on, opening or taking off the piece of luggage takes place by actuating of the switching element by the user of the piece of clothing or of the piece of luggage, preferably using a finger.

Furthermore, the invention relates to a piece of clothing or piece of luggage.

The mentioned rotary closures are known to be used in shoes. For example, reference is made to DE 298 17 003 U1, which discloses a shoe which operates with an electromotively operated rotary closure. Here, a tensioning roller for winding a tensioning element is driven by an electric motor so that the shoe can be automatically laced and unlaced. An electric switch is operated by the user to tie the shoe and the electric motor of the rotary closure is activated as long as the switch is pressed. The lacing force gradually increases accordingly. When a desired lacing force level is reached, the user releases the switch again. Correspondingly, another switch can be actuated to unlace the shoe.

Therefore, the lacing of the shoe requires an appropriate time during which the user must press the switch. In addition, the user must set the desired lacing force level for each lacing.

Similar considerations also apply when an automated closure has to be engaged which can be used for other garments or luggage. Here, too, it is sometimes necessary to put on the garment (e. g. in the form of a cap or jacket) or the piece of luggage (e. g. in the form of a backpack) and fix it to the wearer's body with a specified tension level.

It is the object of the invention to further develop a method of the type mentioned above in such a way that generally the putting on or taking off a piece of clothing onto the wearer or from the wearer of the same or for closing, putting on, opening, or taking off a piece of luggage carried by a person is facilitated. In particular, it shall be possible to achieve this in a comfortable and simple manner. In particular, it should be possible to adapt the putting on or taking off of the piece of clothing or the closing, putting on, opening or taking off of the piece of luggage to individual wishes in a user-friendly manner. This should make it possible to put on the piece of clothing or the piece of luggage respectively with a defined tensioning force level according to the user's wishes without a great operating effort. Furthermore, a corresponding piece of clothing or piece of luggage is to be provided.

The solution of the object by the invention is characterized in that the switching element comprises a number of touch-sensitive sensors which are arranged one beside the other and form a surface which is accessible to the user of the piece of clothing or of the piece of luggage, wherein the method comprises the steps:

Passing over the surface of the touch-sensitive sensors by the user, preferably with the finger, in a first direction, Detecting of the signal of the touch-sensitive sensors by the control means and causing of putting on of the piece of clothing at the wearer of the same or the closing or putting on the carried piece of luggage at a first level of fastening force or with a first closing path of the tensioning element by the control means and the electric motor.

The method can further comprise the steps:

Newly passing over the surface of the touch-sensitive sensors by the user, preferably with the finger, in the first direction, Detecting of the signal of the touch-sensitive sensors by the control means and causing of putting on of the piece of clothing at the wearer of the same or the closing or putting on the carried piece of luggage at a second level of fastening force or with a second closing path of the tensioning element by the control means and the electric motor, wherein the second level of fastening force is higher than the first level of fastening force or the second closing path is bigger than the first closing path.

Thus, a second, higher level of fastening force can be easily reached. This principle can also be continued: The method can also include the steps:

Newly passing over the surface of the touch-sensitive sensors by the user, preferably with the finger, in the first direction, Detecting of the signal of the touch-sensitive sensors by the control means and causing of putting on of the piece of clothing at the wearer of the same or the closing or putting on the carried piece of luggage at a third level of fastening force or with a third closing path of the tensioning element by the control means and the electric motor, wherein the third level of fastening force is higher than the second level of fastening force or the third closing path is bigger than the second closing path.

Further passings of the touch-sensitive sensors can also be carried out to further increase the fastening force level or the closing path step by step. A fastening force level is preferably defined by the current with which the electric motor is operated (see below).

The opening of the piece of clothing or piece of luggage or the reduction of the fastening force level is preferred by carrying out the following steps:

Passing over the surface of the touch-sensitive sensors by the user, preferably with the finger, in a second direction which is opposite to the first direction, Detecting of the signal of the touch-sensitive sensors by the control means and causing of relieving of the tensioning element to a reduced level of the fastening force or to a reduced closing path by the control means and the electric motor.

For the fully relieved end position, the tensioning roller can be equipped with a rotation angle sensor which is able to detect the zero position of the tensioning roller.

The above-mentioned passing of the surface of the touch-sensitive sensors is done according to a preferred procedure in such a way that the user (preferably using a finger) completely passes over the sensors, i. e. over the entire surface area of the sensors. In this way—as described—the fastening force level and the closing path respectively can be increased step by step or in steps; in the same way the fastening force level can be reduced and the piece of clothing or the piece of luggage can be completely opened or prepared for taking off respectively (if the surface is passed in the opposite direction).

However, it is also possible not to pass the surface of the touch-sensitive sensors completely, but only over a part of their extension (with the finger). Depending on the length over which the user has passed the surface, the controller can then send a (preferably proportional) signal to the electric motor so that the tension is increased accordingly and the closing path is increased respectively or reduced (by passing in the opposite direction).

Thus, the proposed procedure allows a stepwise closing (fastening) and opening (relieving) of the piece of clothing and stepwise closing, putting on, opening, or taking off the piece of luggage which is carried by the person respectively, for which the surface of the touch-sensitive sensors is completely or only partially passed over in order to be able to finely adjust said fastening or opening.

This makes it possible, by simply passing over the number of touch-sensitive sensors (in the first direction), to approach specifically defined fastening force levels of the piece of clothing or the piece of luggage and also to open the piece of clothing or the piece of luggage, i. e. release the tension element, by passing over the sensors once (in the second direction).

This makes fastening and relieving and opening and closing respectively very easy and comfortable.

At or on the switching element a number of illumination elements, especially in the form of Light-Emitting Diodes (LED), can be arranged, wherein the actual level of the fastening force is displayed by the number of activated illumination elements. This allows the user of the piece of clothing or the piece of luggage to easily see how tightly the piece of clothing or the piece of luggage is currently fastened at the body. The more LEDs light up, the more the piece of clothing or the piece of luggage is tightened. The open state of the piece of clothing or the piece of luggage can also be indicated by the LEDs.

The proposed piece of clothing or piece of luggage with rotary closure and switching element is characterized by the invention in that the switching element is formed by a number of touch-sensitive sensors which are arranged one beside the other which form a surface which is accessible to a user of the piece of clothing or piece of luggage (especially for a finger of the user). The common surface of the sensors is as smooth and even as possible.

This is to be understood in such a way that the individual touch-sensitive sensors can be activated by passing over the surface in order to generate the above-mentioned functionality.

The single touch-sensitive sensors are thereby designed preferably as capacitive sensors.

The single touch-sensitive sensors are arranged preferably side by side in a linear formation, wherein preferably between 3 and 7 touch-sensitive sensors are arranged side by side.

At or on the switching element a number of illumination elements, especially LEDs, are preferably arranged.

According to a preferred embodiment the switching element and the rotary closure are arranged at different locations of the piece of clothing or piece of luggage. But also a combination with the rotary closure to form a unit (consisting of rotary closures and switching element) is possible.

As explained above, the user will usually pass over the surface of the touch-sensitive sensors with his finger. However, this is not mandatory; it can also be provided that an aid (e. g. a pen) is used for passing.

Spring means can be arranged in the piece of clothing or the piece of luggage which bias the piece of clothing or the piece of luggage against the force of the tensioning element in an open-position. This ensures that the piece of clothing or the piece of luggage "folds open" into an open position after the rotary closure has been opened, making it easier to put on and take off the piece of clothing or the piece of luggage.

For the supply of energy preferably a rechargeable battery is arranged in the piece of clothing or the piece of luggage which is rechargeable inductively and/or contactless. In this case, the battery required for the operation of the motor is therefore designed as a rechargeable battery and is supplied with a charging current via an induction coil. The electronics required for charging can be placed directly on the battery. By providing an induction coil, the battery of the piece of clothing or the piece of luggage can be charged without contact. The piece of clothing or the piece of luggage can be placed on an appropriate charging plate to charge the battery. The LEDs mentioned above can also be used to indicate charging or the charging status. For example, the LEDs may flash during charging, with more and more LEDs flashing as the battery is charged more and more.

It can also be provided that the state of charge of the battery is indicated by the LEDs while the piece of clothing or the piece of luggage is in use. For example, at a certain charge level (e. g. when the battery is less than 50% of its maximum charge level) the LEDs may start flashing.

The piece of clothing or the piece of luggage can also comprise an interface which is designed for a wireless communication with a mobile phone, especially for the communication via Bluetooth. Thus, communication with the mobile phone (smartphone) can take place via a wireless connection and in this case the switching element can be moved into the mobile phone; in this case the switching element is formed by the mobile phone. This means that the rotary closure can be controlled wirelessly via Bluetooth using a smartphone, which is equipped with a corresponding app for this purpose.

The piece of clothing is preferably a cap, jacket, trousers, hoodie, bra or belt. The piece of luggage is particularly a backpack and a sports or travel bag. In these applications, the proposed method and the closure system described can be used to particular advantage.

The touch-sensitive sensors mentioned here are commercially available as such and are also referred to as "swipe sensor" or "touch panel". These are generally a number (usually between three and seven) of sensors arranged next to each other, each of which is touch-sensitive. This enables the controller to recognize which action (closing or opening/putting on or taking off) is to be carried out by means of the sequence of measured impulses from the individual sensors at passing in the first or second direction.

The first fastening force level is preferably defined by a first predetermined maximum current, which the controller sets for the electric motor during the fastening process; this current is preferably between 1.1 A and 1.9 A. The second fastening force level is defined analogously and preferably by a second predetermined maximum current which the control gives to the electric motor during the fastening operation, wherein the second maximum current being higher than the first maximum current; said current preferably being between 2.1 A and 2.9 A. The third level of fastening force is correspondingly preferably defined by a third predetermined maximum current which the controller gives to the electric motor during the fastening operation, wherein the third maximum current being higher than the second maximum current; the current is preferably between 3.1 A and 3.9 A.

These fastening force levels are thus defined by the specification of a corresponding motor current (e. g. first level: 1.5 A-second level: 2.5 A-third level: 3.5 A), so that the motor is operated with corresponding maximum torques, which in turn leads to a corresponding increasing tensile force in the tensioning element via the preferred gear between motor and tensioning roller.

The tensioning elements are preferably tensioning wires. They can comprise polyamide or can be made of this material.

In an advantageous way, the ease of use can be improved when using a piece of clothing or a piece of luggage with an electromotive lacing system with a rotary closure.

According to an embodiment of the piece of clothing or piece of luggage, provision may be made for two tensioning elements to be provided which are wound simultaneously by the tensioning roller, thus exerting a uniform tensioning pressure on the body of the person wearing the garment or luggage.

Of course, this design will not make sense for all the applications mentioned. However, this can be advantageously used, for example, when putting on a backpack, where the two carrying straps of the same are then tensioned simultaneously by two tensioning elements. The same applies to a jacket and trousers.

The two tensioning elements are attached with their two ends to the tensioning roller and each form a closed curve on two sides of the garment or luggage. The two curves of the two tensioning elements can be essentially symmetrical to a central plane of the garment or luggage.

The proposed method may also be further developed by placing a pressure sensor on or inside the piece of clothing or the piece of luggage to detect the degree of fastening tension of the piece of clothing or the piece of luggage on the wearer's body. This pressure can be compared with a value stored in the controller. If a too high pressure is detected while wearing the piece of clothing or the piece of luggage, it can be provided that the control automatically causes a reduction of the fastening tension. Conversely, if the pressure is too low, the piece of clothing or the piece of luggage can also be fastened again, which can be done by the control system self-sufficiently.

In the drawings an embodiment of the invention is shown.

Figure 2:
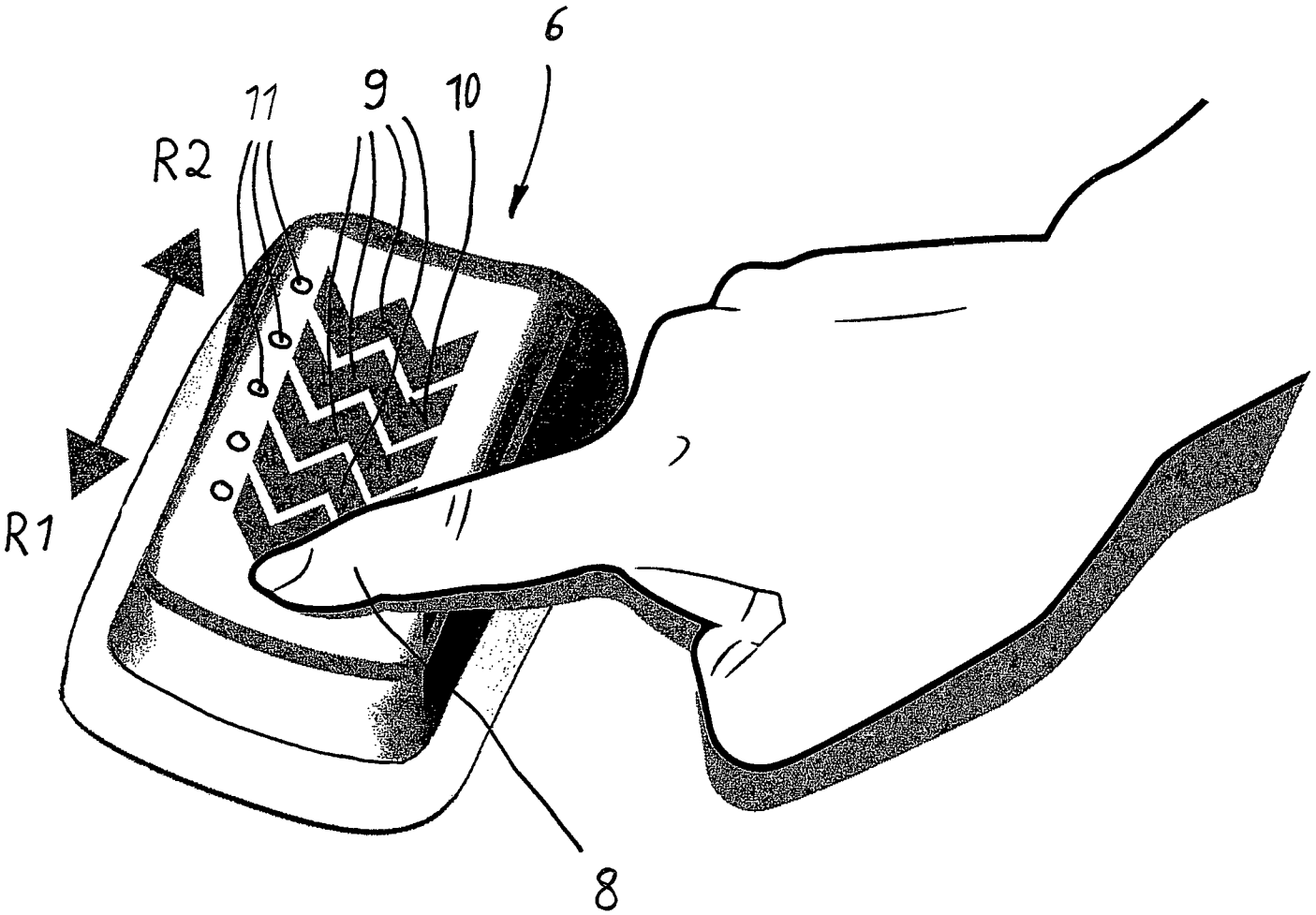

FIG. 1 shows schematically in the side view a hat, depicted partially cut, which can be fastened with a rotary closure at the head of the wearer and FIG. 2 shows in perspective view a switching element for the actuation of the rotary closure by the finger of the person which uses the hat.

FIG. 1 shows a garment 1 in the form of a hat. The hat 1 is designed as a peaked cap; the visor is marked with 13. If the hat 1 is placed on the (not shown) head of the wearer, it can be tensioned with a desired tension level at the head of the wearer. A tensioning strap 12 is provided for this purpose. With conventional solutions, the tensioning strap is adjusted manually to a desired tensioning force level.

In the proposed solution, an electromotive solution is provided for this: A rotary closure 2 with a tensioning roller 4 is integrated in the hat 1. The tensioning roller 4 tensions a tensioning element 3 which is connected to the tensioning strap 12. An electric motor 5 actuates the tensioning roller 4 via a gearing not shown. The electric motor 5 is controlled by control means 7. A switching element 6 is provided for actuating the rotary closure 2 (via the electric motor 5 and the control means 7).

In the embodiment, the switching element 6 is located in the front of the hat and is easily accessible by a finger of the user.

To tighten and loosen the tensioning strap 12 at the head of the wearer of the hat 1, the user proceeds as follows:

As shown in FIG. 2, the switching element 6 has a surface 10 equipped with a number of touch-sensitive sensors 9. Specifically, five touch-sensitive sensors 9 are arranged linearly next to each other. The individual touch-sensitive sensors 9 are designed as capacitive sensors, which are known as such in the state of the art. They react to contact with the finger 8 of the user of hat 1.

To close the tensioning strap 12 of the hat 1, the user sweeps the touch-sensitive sensors 9 in a first direction R1 with his finger 8. If the control means 7 detect said contacting of the sensors 9, they cause a first tensioning force level to be reached, i. e. the electric motor 5 is operated with a first, preset maximum value for the motor current, e. g. 1.5 A.

Illumination elements 11 in the form of LEDs are arranged on switching element 6. By activating one or more of the illumination elements 11, the approached tensioning force level can be displayed to the user (which he can only see in a mirror in the embodiment).

If the passing of sensors 9 is repeated with finger 8 in the first direction R1, a second, higher tensioning force level can be approached; a second, specified maximum value for the motor current can now be 2.5 A, for example.

If the sensors 9 are passed again, the tensioning force level can be further increased; a third, specified maximum value for the motor current can now be 3.5 A, for example.

Depending on the transmission ratio between motor 5 and tensioning roller 4 and depending on the geometric conditions up to the point where the tensioning element 3 reaches the tensioning strap 12, corresponding levels of tensioning force result.

The illumination elements 11 can in turn be used to indicate the current tensioning force level.

To open the tensioning strap 12, the user uses his finger 8 to sweep the surface 10, i. e. the touch-sensitive sensors 9, in a second direction R2, opposite to the first direction R1. The control means 7 then initiate the complete opening of the tensioning strap 12. The electric motor 5 then moves into the completely relaxed state, which can be determined by a corresponding rotation angle sensor on the tensioning roller 4.

This means that the user does not have to operate a closing or opening switch for a long time; it is sufficient to pass over the touch-sensitive sensors 9 as described.

The user can thus advantageously approach a tensioning force level that is suitable for his requirements without having to adjust this by pressing the closing switch for a corresponding length of time.

The example shows a hat. Of course, the proposed principle can also be used for many other applications.

In this regard, clothing such as, in particular, (sports) jackets and (sports) trousers are mentioned, in which certain geometric relations are adjustable, such as the tension of the clothing in the hip area or the length of trouser legs and sleeves. For a (sports) jacket, it is also conceivable to automatically raise or lower a hood. For jackets in particular, automatic opening and closing can also be provided. The above mentioned design is also very advantageous for use with a bra (brassiere).

Other particularly advantageous applications are backpacks. Here the length of the carrying straps can be adjusted as described in order to adapt the backpack to the needs of the wearer. Again, automatic opening and closing can also be provided for this application. The same applies to bags, in particular sports bags and travel bags, where only automatic opening and closing is usually provided for.

Another application is the integration of the described device into a belt, with which the (tensioning) length can be adjusted in the way described.

REFERENCE NUMERALS

1 Piece of clothing
2 Rotary closure
3 Tensioning element
4 Tensioning Roller
5 Electric motor
6 Switching element
7 Control means
8 Finger
9 Touch-sensitive sensor
10 Surface
11 Illumination element (LED)
12 Tensioning strap
13 Visor
R1 First direction

The invention claimed is:

1. A method for putting on or taking off a hat, a jacket, trousers, a hoodie, a bra or a belt onto a wearer or from the wearer of the same or for closing, putting on, opening, or taking off a backpack or a sports or travel bag carried by a person, wherein the hat, the jacket, the trousers, the hoodie, the bra, the belt, the backpack or the sports or travel bag comprises:

a rotary closure for tightening of the hat, the jacket, the trousers, the hoodie, the bra or the belt at the wearer or loosening of the same from the wearer or for closing, putting on, opening or taking off the backpack or the sports or travel bag by at least one tensioning element, wherein the rotary closure comprises a rotatably arranged tensioning roller for winding the tensioning element, wherein the tensioning roller is driven by an electric motor, a switching element which is connected to a controller, wherein the switching element and the controller can actuate the electric motor, wherein the tightening of the hat, the jacket, the trousers, the hoodie, the bra or the belt at the wearer or loosening of the same from the wearer or the closing, putting on, opening or taking off the backpack or the sports or travel bag takes place by actuating of the switching element by the user of the same using a finger, wherein the switching element comprises a number of touch-sensitive sensors which are arranged one beside the other and form a surface which is accessible to the user, wherein the method comprises:

passing the finger of the user over the surface of the touch-sensitive sensors in a first direction, detecting the signal of the touch-sensitive sensors by the controller and causing of putting on of the hat, the jacket, the trousers, the hoodie, the bra or the belt, or the closing or putting on the carried backpack or the sports or travel bag at a first level of fastening force or with a first closing path of the tensioning element by the controller and the electric motor.

2. The method according to claim 1, wherein the method further comprises:

passing the finger of the user over the surface of the touch-sensitive sensors in the first direction, detecting the signal of the touch-sensitive sensors by the controller and causing putting on of the hat, the jacket, the trousers, the hoodie, the bra or the belt or the closing or putting on the carried backpack or the sports or travel bag at a second level of fastening force or with a second closing path of the tensioning element by the controller and the electric motor, wherein the second level of fastening force is higher than the first level of fastening force or the second closing path is bigger than the first closing path.

3. The method according to claim 2, wherein the method further comprises:

passing the finger of the user over the surface of the touch-sensitive sensors in the first direction, detecting the signal of the touch-sensitive sensors by the controller and causing putting on of the hat, the jacket, the trousers, the hoodie, the bra or the belt or the closing or putting on the carried backpack or the sports or travel bag at a third level of fastening force or with a third closing path of the tensioning element by the controller and the electric motor, wherein the third level of fastening force is higher than the second level of fastening force or the third closing path is bigger than the second closing path.

4. The method according to claim 1, wherein the method further comprises:

passing the finger of a user over the surface of the touch-sensitive sensors in a second direction which is opposite to the first direction, and detecting the signal of the touch-sensitive sensors by the controller and causing relieving of the tensioning element to a reduced level of the fastening force or to a reduced closing path by the controller and the electric motor.

5. The method according to claim 1, wherein at or on the switching element a number of illumination elements are arranged, wherein the actual level of the fastening force or of the actual closing path is displayed by the number of activated illumination elements.

6. The method according to claim 5, wherein the illumination elements are light emitting diodes (LEDs).

7. The method according to claim 1, wherein the fastening force level of the tensioning member is increased in steps.

8. A method for tightening an article, comprising:

providing a rotary closure for tightening the article, wherein the rotary closure comprises a tensioning roller for winding a tensioning element, and the tensioning roller is driven by an electric motor, providing a switching element that is connected to a controller, wherein the switching element and the controller can actuate the electric motor, tightening of the article takes place by actuating of the switching element by a user of the same using a finger, and the switching element comprises a plurality of touch-sensitive sensors that are arranged one beside the other, passing the finger of the user over the surface of the touch-sensitive sensors in a first direction, and detecting the signal of the touch-sensitive sensors by the controller and causing tensioning of the tensioning element by the controller and the electric motor, wherein a fastening force level of the tensioning element is increased in steps.

9. The method according to claim 8, wherein the method further comprises:

passing the finger of the user over the surface of the touch-sensitive sensors in the first direction, and detecting the signal of the touch-sensitive sensors by the controller and causing the tensioning element to achieve a second level of fastening force.

10. The method according to claim 9, wherein the second level of fastening force is higher than the first level of fastening force or the second closing path is bigger than the first closing path.

11. The method according to claim 9, wherein the method further comprises:

passing the finger of the user over the surface of the touch-sensitive sensors in the first direction, detecting the signal of the touch-sensitive sensors by the controller and causing the tensioning element to achieve a third level of fastening force.

12. The method according to claim 8 further comprises:

passing the finger of a user over the surface of the touch-sensitive sensors in a second direction which is opposite to the first direction, and detecting the signal of the touch-sensitive sensors by the controller and causing relieving of the tensioning element to a reduced level of the fastening force or to a reduced closing path by the controller and the electric motor.

13. The method according to claim 8, wherein a plurality of illumination elements are arranged along the switching element, wherein the actual level of the fastening force or of the actual closing path is displayed by the plurality of activated illumination elements.

14. The method according to claim 8, wherein the illumination elements are light emitting diodes (LEDs).

15. A device for putting on or taking off an article, comprising:

a rotary closure for tightening the article that includes at least one tensioning element, wherein the rotary closure comprises a rotatably arranged tensioning roller for winding the tensioning element, wherein the tensioning roller is driven by an electric motor, a switching element which is connected to a controller, wherein the switching element and the controller can actuate the electric motor, wherein the tightening of a hat, a jacket, trousers, a hoodie, a bra or a belt, or the closing, putting on, opening or taking off a backpack or a sports or travel bag takes place by actuating of the switching element, wherein the switching element comprises a number of touch-sensitive sensors which are arranged one beside the other and form a surface which is accessible to a user, wherein the touch-sensitive sensors are configured to receive a first swipe by the user, which causes the electric motor to rotate the tensioning roller to a first level of fastening, and wherein a second swipe along the touch-sensitive sensors by a user causes the electric motor to rotate the tensioning roller to a second level of fastening.

16. The device according to claim 15, wherein a third swipe in a direction opposite the first swipe and the second swipe causes the electric motor to rotate the tensioning roller in a reverse direction.

17. The device according to claim 15, wherein a plurality of illumination elements are arranged along the switching element, wherein the illumination elements display to a user the level of fastening.

18. The device according to claim 17, wherein the illumination elements are light emitting diodes (LEDs).

19. The device according to claim 15, wherein a fastening force level of the tensioning element is configured to increased in steps.

* * * * *